US007527366B2

(12) United States Patent
Jones

(10) Patent No.: US 7,527,366 B2
(45) Date of Patent: May 5, 2009

(54) SEAL MEMBER FOR INK JET CONTAINER

(75) Inventor: Bruce S. Jones, Franklin, TN (US)

(73) Assignee: Nu-kote International, Inc., Franklin, TN (US)

( * ) Notice: Subject to any disclaimer, the term of this patent is extended or adjusted under 35 U.S.C. 154(b) by 95 days.

(21) Appl. No.: 10/774,580

(22) Filed: Feb. 9, 2004

(65) Prior Publication Data

US 2005/0174400 A1 Aug. 11, 2005

(51) Int. Cl.
*B41J 2/175* (2006.01)

(52) U.S. Cl. ..... 347/85; 347/86; 277/626; 277/644; 277/649

(58) Field of Classification Search ..... 347/85, 347/86; 277/626, 643, 644, 649, 612, 647, 277/648

See application file for complete search history.

(56) References Cited

U.S. PATENT DOCUMENTS 6,164,769 A * 12/2000 Inada et al. ..... 347/86
6,695,757 B2 * 2/2004 Edwards et al. ..... 493/51
2002/0130473 A1 * 9/2002 Doyle ..... 277/612
2002/0191059 A1 * 12/2002 Jones et al. ..... 347/86
2003/0081085 A1 * 5/2003 Putman et al. ..... 347/86
2003/0128257 A1 * 7/2003 Qingguo et al. ..... 347/85
2004/0021751 A1 * 2/2004 Steinmetz et al. ..... 347/86
2004/0036749 A1 * 2/2004 Petranek ..... 347/86

* cited by examiner

*Primary Examiner*—Manish S Shah
*Assistant Examiner*—Laura E Martin
(74) *Attorney, Agent, or Firm*—Fay Sharpe LLP

(57) ABSTRACT

An ink container has a housing having a chamber formed therein for receiving ink and a first surface containing an outlet passage communicating with the chamber and through which ink is selectively dispensed. An air impermeable, non-porous seal member is received in the outlet passage, and has raised portions on opposite sides of the member. A cap member is provided to compress the seal within the outlet passage to form a seal therein.

14 Claims, 2 Drawing Sheets

SEAL MEMBER FOR INK JET CONTAINER

BACKGROUND OF THE INVENTION

This invention relates to an ink jet container or cassette as used in an ink jet printer; and more particularly to an apparatus and method for reducing the introduction of air into the system. Specifically, the invention relates to an improved seal for an ink jet container using a compressive linear seal. It will be appreciated, however, that the invention may find application in related environments and applications that encounter the same issues.

It is generally known in the art to form a container housing or body having one or more cavities or chambers that hold a predetermined supply of ink. For example, a single color of ink may be provided in a single chamber container. Alternatively, multiple chambers may be provided, for example, each holding a different color ink stored therein for selective use in a color printer. It is also generally known to provide an ink absorbing member such as a reticulated polyethylene or melamine foam that fits within the chamber(s). In some arrangements, the ink absorbing member fills the substantial entirety of the chamber, while in other instances a portion of the ink supply is free ink and the remainder is stored in the ink absorbing member. In still other instances, all of the ink is stored as free ink in the container. One or more outlet ports communicate with the respective one or more chambers through outlet passages. The outlet passage proceeds through a first or bottom wall of the housing. A supply needle from an associated printer extends through the outlet port and thus conveys ink from the housing to a recording head or printhead.

Print quality can be adversely affected by the introduction of air into the ink chamber or outlet passage. Thus, manufacturers of ink containers are careful in the design and assembly, i.e., filling, to limit the potential for air introduction into the system. One area of potential air introduction is through a seal member such as a grommet or septum that normally closes the outlet port. Seal members as used in commercially available containers are typically made from a porous material that allows permeation of both air and water. The entry of air through the seal member can dramatically affect performance of the printer, allowing air bubbles to form in the outlet port thus creating print voids or ink starvation problems. Existing seals seal using an external ring that acts like an o-ring. However, the o-ring may be difficult to install and may leak since the bore of the outlet port may not be round or there are variations in the geometry of the outlet port.

Another problem that occurs is that the chimney of the ink container is molded and does not always have a smooth base on the internal diameter of the chimney due to factors such as material shrinkage during the molding process. As a result, a proper interference fit between the outer diameter of a seal disk and the internal diameter of the chimney bore is not achieved.

Accordingly, there exists a need for providing a sealing disk which is compressed upon insertion into a bore of an outlet port of an inkjet container thus limiting the potential for air to enter the container through the outlet port.

SUMMARY OF THE INVENTION

The present invention provides an ink container in which a housing has a chamber formed therein for receiving ink and a first or lower surface containing an outlet passage communicating with the chamber. An air-impermeable, non-porous seal disk member is received in the outlet passage for preventing air from entering the container through the outlet passage.

An air and liquid tight seal is accomplished by linear compression of the seal ring and a welded cap. The seal member is preferably formed of one of silicone rubber or any suitable flexible material. The seal member includes a thin membrane which extends across an outlet passage and has ridges formed on top and bottom surfaces of the membrane which are compressed upon installing the seal.

More particularly, an ink container has a housing having a chamber formed therein for receiving ink and a first surface containing an outlet passage communicating with the chamber and through which ink is selectively dispensed. An air impermeable, non-porous seal member is received in the outlet passage and has raised portions on a first surface and a second surface, wherein the surfaces are on opposite sides of the member. The raised portions can have substantially V-shaped ridges.

A cap member is provided having an aperture located centrally therein, and further having a recess for receiving the outlet passage. The outlet passage can have a rib on an outer surface thereof which contacts the cap and is melted via welding until the rib is substantially flush with the outer surface. The seal is adapted to be compressed between the cap and the outlet passage. The seal member can have a generally tube-shaped portion which engages an inner wall of the outlet passage. A thin membrane extends across the tube-shaped portion of the seal member. The membrane is adapted to be selectively pierced by a needle of a printer. The outlet passage includes a counterbore at an outer terminal end that receives the disk-shaped seal member therein.

One advantage of the present invention resides in the improved print quality that results.

Another advantage of the present invention relates to the reduction of air introduced into the printing system.

One aspect of the present invention relates to providing a seal member which is compressed between a cap and the outlet port to seal the port from air.

Still other aspects and advantages of the invention will become apparent to those skilled in the art upon reading and understanding the following detailed description.

BRIEF DESCRIPTION OF THE DRAWINGS

The invention may take form in certain components, structures, and steps, preferred embodiments of which are illustrated in the accompanying drawings, wherein.

DETAILED DESCRIPTION OF THE INVENTION

Figure 2:
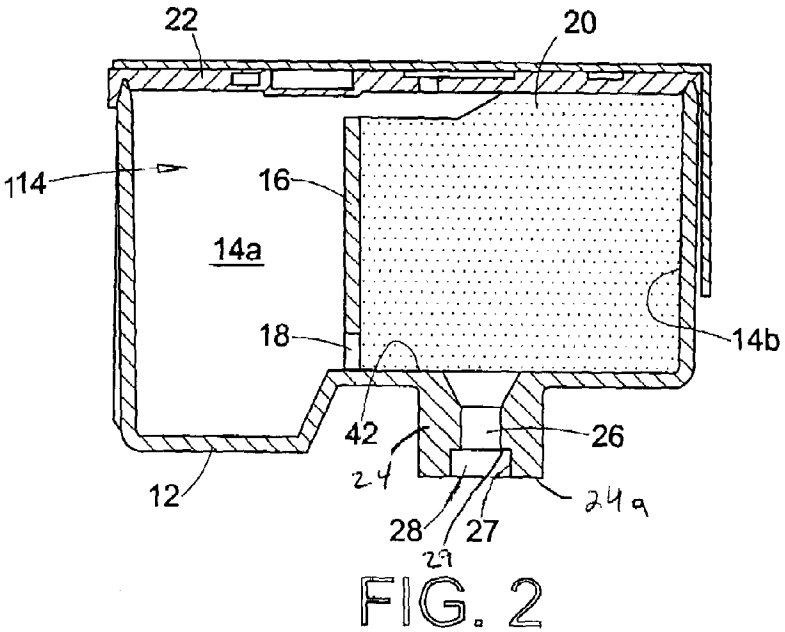
FIG. 2 is a longitudinal cross-sectional view of the assembled ink container components of FIG. 1.
Figure 1:
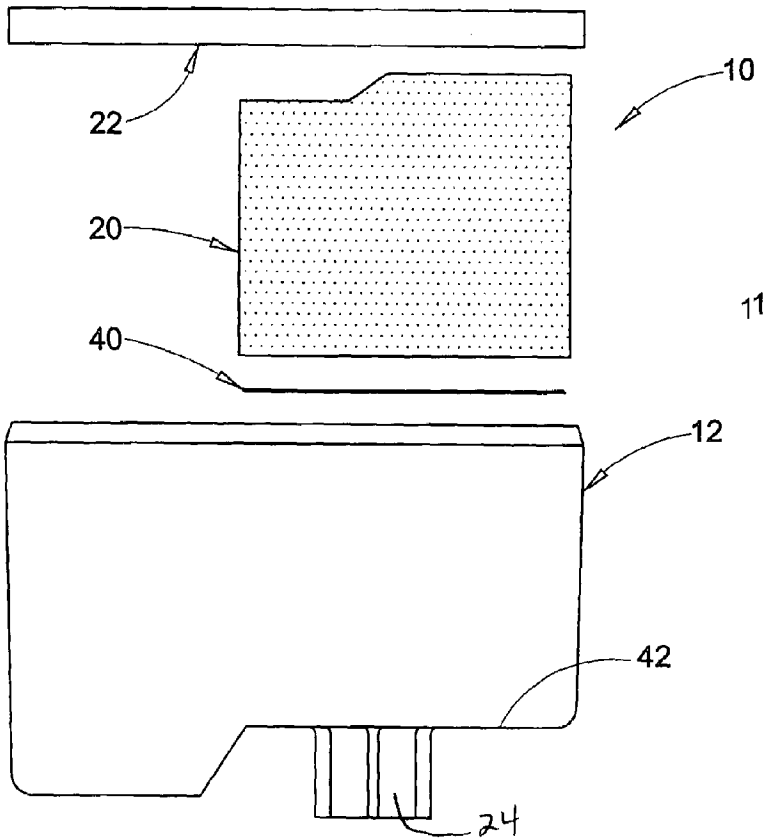
FIG. 1 is an exploded view of the individual components of an ink container.

As illustrated in FIGS. 1 and 2, an ink jet cassette or container 10 includes a housing 12 having an internal chamber or cavity 14 (FIG. 2). As shown here, cavity 14 is divided into two chambers 14*a*, 14*b* by a dividing wall 16. It will be appreciated, however, that the housing may have one chamber, or multiple chambers. For example, the container may be a partially free ink/partially absorbent foam design, as shown, entirely foam, entirely free ink, or the container may be a single color versus multi-color container as noted above. The invention is not limited to a single or multi-chamber arrangement. In the partial free ink/partial foam design, a passageway 18 is provided in a base portion of the dividing wall to allow ink to migrate from the free ink side 14*a* to an ink absorbing member 20 in chamber 14*b*. The ink absorbing member is typically a block of porous material or foam such as a reticulated polymer foam or melamine foam, or other conventional ink absorbing member used to store ink within the pores thereof.

As shown in FIG. 2, with the partial free ink/partial foam design, the ink absorbing member 20 substantially fills the entire chamber 14*b* on the foam side of the container. In other designs that do not employ free ink, the ink absorbing member will fill substantially the entire cavity or portions of a chamber. Again, the invention is not limited to any one of these designs.

A lid or cover 22 is received over a first or upper end of the housing and is typically sealingly secured in place. For example, the cover may be ultrasonically welded along a peripheral portion to the cartridge housing to seal the components together. A thin filter screen 40 preferably formed of a mesh material, is inserted on a bottom surface 42 of the ink container between the ink absorbing member and an ink outlet port 24.

The ink outlet port 24 communicates via an outlet passage 26 with the chamber of the cartridge. A counterbore 28 is formed extending into port 24 from a bottom surface 24*a* thereof. The counterbore has a peripheral wall 27, and an inner wall 29. Ink flows from the ink chamber through the outlet passage 26 and ultimately from the outlet port 24.

Figure 3:
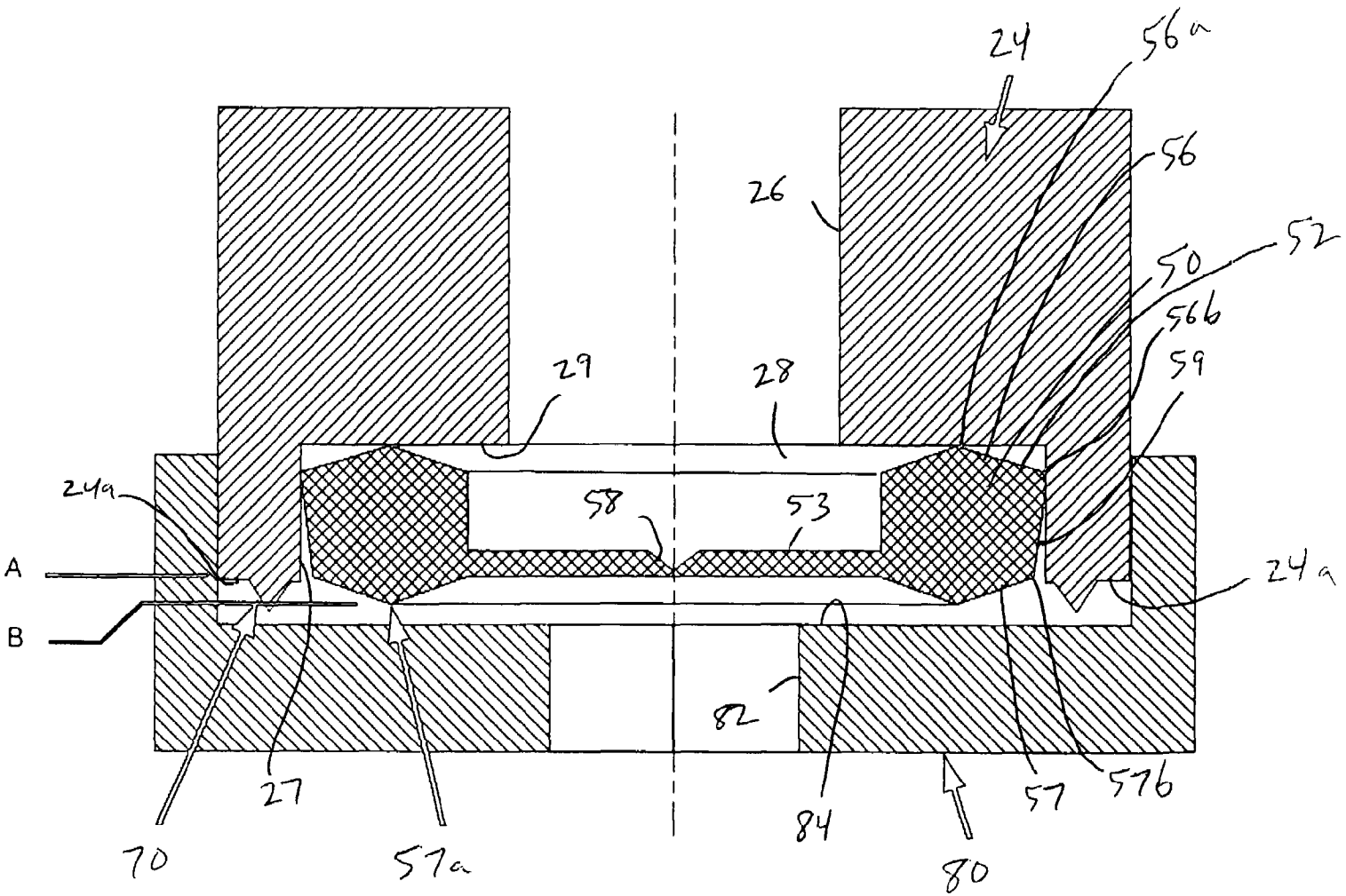
FIG. 3 is an enlarged longitudinal cross-section of a seal and cap assembly according to the present invention.

Referring now to FIG. 3, the outlet passage receives an air-impermeable, non-porous seal member or disk 50 (see FIG. 3) that is selectively pierced by a needle from an associated printer (not shown). Once the seal disk is pierced, communication is established between the ink in the chamber/outlet passage and the printer in a manner generally well known in the art.

With continued reference to FIG. 3, the preferred seal member or disk 50 is shown in detail. The seal member has a generally disk-shaped configuration and is used to seal an ink supply needle of the ink jet printer. This disk-like configuration includes a first or upper tube or ring shaped portion 52 that is dimensioned to be received by the similarly sized counterbore 28 formed inwardly from bottom surface 24*a* of the ink jet cartridge outlet port 24. A substantially V-shaped upper surface 56 having a vertex 56*a* is formed along the upper side of portion 52 and, similarly, a bottom surface 57 which is substantially V-shaped and has a vertex 57*a* is formed along the lower side of portion 52. A thin membrane 53 extends across the inner periphery of portion 52 adjacent bottom surface 57. A tapering portion 58 of the membrane acts as a guide to direct the printer needle toward the membrane hereby the membrane is selectively pierced by the printer needle at the narrowest strip of the membrane.

The seal disk is inserted into the counterbore of the ink outlet port of the ink jet cartridge and is positioned so that V-shaped ridge 56*a* on the top surface rests on the counterbore surface 29 of the outlet port. The ring-shaped portion 52 has a tapered outer wall 59 which tapers downwardly and inwardly from the radially outer edge 56*b* of upper surface 56 to the radially outer edge 57*b* of bottom surface 57 such that the upper end of first portion 52 is radially thicker than the lower end. Further, for the purpose set forth hereinafter, only edge 56*b* engages wall 27 of the counterbore when the seal member is initially inserted into the counterbore.

Referring further to FIG. 3, an ultrasonic weld rib 70 extends along the circumference of the outer surface 24*a* of the outlet port. The rib, which is generally triangular in shape, serves as an energy director. A circular cap 80 with a through hole 82 is installed onto the outlet port and acts to compress the seal disk. The cap has an outer diameter greater than that of the outlet port. The cap has a recess 84 into which the outlet port is received. The cap is preferably formed of a plastic material.

The side walls of the ring or tube are tapered or sloped from the upper portion to the lower portion. The tapered configuration allows the seal to be easily inserted into the bore and avoid a friction-like engagement with the inner walls of the bore. The seal can then be seated property within the bore. As the seal is compressed, the tapered walls are pushed into full contact with the bore inner walls and provide a tighter seal.

The V-shaped ridge on the top and bottom portions provide areas which are also compressed to provide a tighter seal between the seal and the outlet opening bore.

The disk is compressed by an air cylinder of an ultrasonic welder (not shown) which welds the cap onto the outlet port, thereby melting the weld rib via vibration energy until surface "B" shown in FIG. 3 is in substantially the same plane as surface "A". The position of the cap and seal is held by the welder for a sufficient period of time (i.e. several seconds) past the vibration cycle to allow the cap to cool.

The seal disk of the present invention can use an alternative seal member material such as silicone rubber, polyvinyl chloride, or treated thermoplastic rubber. For example, Silopren® LSR (a registered trademark of the General Electric Company) is a two-component liquid silicone rubber that exhibits the high thermal stability and excellent performance in limiting permeation of both air and water that could otherwise tend to form bubbles in the outlet port. This material is commercially available from the General Electric Company under this trade designation. Another alternative is a liquid silicone rubber, under the trade designation LIM® 6061 (a registered trademark of the General Electric Company). This too, is a high tensile strength rubber.

The application has been described with reference to the preferred embodiment. Obviously, modifications and alterations will occur to others upon reading and understanding the specification. It is intended to include all such modifications and alterations insofar as they come within the scope of the appended claims or the equivalents thereof.

invention claimed is:

1. An ink container comprising:

a housing having a chamber formed therein for receiving ink and a surface including an outlet passage communicating with the chamber and through which ink is dispensed; and an air impermeable, non-porous seal member received in the outlet passage, said seal member comprising a substantially V-shaped first surface extending from a first end of a first sidewall of said seal member having a first vertex and a substantially V-shaped second surface having a second vertex, said second surface extends from a second opposite end of said first sidewall of said seal member wherein said first surface faces away from said second surface, wherein said surfaces are on opposite exterior sides of said member, and said surfaces are adapted to be compressed when said seal member is installed in said outlet passage.

2. An ink container comprising:

a housing having a chamber formed therein for receiving ink and a surface including an outlet passage communicating with the chamber and through which ink is dispensed; and an air impermeable, non-porous seal member received in the outlet passage, said seal member comprising a substantially V-shaped first surface extending from a first end of a first sidewall of said seal member having a first vertex and a substantially V-shaped second surface having a second vertex, said second surface extends from a second end of said first sidewall of said seal member wherein said first surface faces away from said second surface, wherein said surfaces are on opposite exterior sides of said member, and said surfaces are adapted to be compressed when said seal member is installed in said outlet passage, and wherein an outer terminal end of said outlet passage comprises a generally triangular-shaped rib extending at least partially along a circumference thereof for contacting and thermally bonding a cap to said outlet passage.

3. The ink container of claim 2, wherein said cap has a through hole and a recess for receiving said outlet passage.

4. The ink container of claim 2, wherein said seal is adapted to be linearly compressed between said cap and said outlet passage.

5. The ink container of claim 2, wherein said cap is formed of plastic.

6. The ink container of claim 1, wherein said seal member is formed of a rubber.

7. The ink container of claim 1, wherein the seal member is formed of a polyvinyl chloride (PVC).

8. The ink container of claim 1 wherein said seal member is formed of a thermoplastic rubber.

9. The ink container of claim 1 wherein said seal member is formed of silicone rubber.

10. The ink container of claim 1, wherein said seal member engages an inner wall of said outlet passage.

11. The ink container of claim 1 wherein the seal member includes a ring shaped portion and a thin membrane extending across the first surface of said ring shaped portion, said thin membrane adapted to be selectively pierced by an associated needle of an associated printer.

12. The ink container of claim 1 wherein the seal member has a substantially disk shape including a tube shaped portion, said tube shaped portion including said first and second surfaces.

13. The ink container of claim 1 wherein the outlet passage includes a counterbore at an outer terminal end that receives the seal member therein, the first vertex of the first surface extending past the outer terminal end, the second vertex of the second surface engaging an inner wall of the counterbore.

14. The ink container of claim 1, wherein said first sidewall of said seal is tapered.

* * * * *